US008179284B2

(12) United States Patent
Pitot et al.

(10) Patent No.: US 8,179,284 B2
(45) Date of Patent: May 15, 2012

(54) DEVICE AND METHOD FOR DETECTING THE DIGITAL ORIGIN OF AN ANALOGUE SIGNAL

(75) Inventors: Christian Pitot, Boulogne Billancourt (FR); Jacques Phelippeau, Saulx-Marchais (FR); Philippe Bieth, Saclay (FR)

(73) Assignee: Thales, Neuilly sur Seine (FR)

( * ) Notice: Subject to any disclaimer, the term of this patent is extended or adjusted under 35 U.S.C. 154(b) by 517 days.

(21) Appl. No.: 12/491,821

(22) Filed: Jun. 25, 2009

(65) Prior Publication Data

US 2010/0007527 A1 Jan. 14, 2010

(30) Foreign Application Priority Data

Jul. 8, 2008 (FR) ..... 08 03880

(51) Int. Cl.
*G08B 23/00* (2006.01)

(52) U.S. Cl. ..... 340/945; 340/963; 340/384.1; 704/246; 704/E17.002; 704/200; 341/126; 379/88.16

(58) Field of Classification Search ..... 340/963, 340/945, 384.1; 704/246, E17.002, E13.004, 704/200; 341/261; 379/88.01, 88.02, 88.16; 455/563

See application file for complete search history.

(56) References Cited

U.S. PATENT DOCUMENTS

| | | | |
|---|---|---|---|
| 5,701,315 | A | 12/1997 | Pitot et al. |
| 5,719,577 | A | 2/1998 | Pitot et al. |
| 6,204,786 | B1 | 3/2001 | Bieth et al. |
| 6,389,485 | B1 | 5/2002 | Chelstowski et al. |
| 2002/0199127 | A1 | 12/2002 | Pitot et al. |
| 2003/0076780 | A1 | 4/2003 | Loge et al. |
| 2004/0015717 | A1 | 1/2004 | Colas et al. |
| 2009/0204870 | A1 | 8/2009 | Bieth et al. |

FOREIGN PATENT DOCUMENTS

| | | | |
|---|---|---|---|
| DE | 202006018730 | U1 | 3/2007 |
| EP | 0740278 | A | 10/1996 |
| FR | 2723222 | A1 | 2/1996 |
| WO | 9634465 | A1 | 10/1996 |

*Primary Examiner* — Brent Swarthout
*Assistant Examiner* — Hongmin Fan
(74) *Attorney, Agent, or Firm* — Stroock & Stroock & Lavan LLP

(57) ABSTRACT

The present invention relates to an alarm management system intended to be carried onboard an aircraft. More precisely, the invention is aimed at improving the certainty level relating to the integrity of the announcements of faults or information intended for the pilot and based on voice syntheses. For this purpose, the present invention proposes a device and a method for detecting the digital origin of an analog signal providing a validity signal (VAL) enabling the voice announcements made to the pilot to be rendered secure.

12 Claims, 2 Drawing Sheets

DEVICE AND METHOD FOR DETECTING THE DIGITAL ORIGIN OF AN ANALOGUE SIGNAL

CROSS-REFERENCE TO RELATED APPLICATION

The present application claims the benefit of French Patent Application No. 08 03880, filed Jul. 8, 2008, which is hereby incorporated by reference in its entirety.

FIELD OF THE INVENTION

The present invention relates to an alarm management system, customarily called a Flight Alarm System, intended to be carried onboard an aircraft. More precisely, the invention is aimed at improving the certainty level relating to the integrity of the announcements of faults or information intended for the pilot and based on voice syntheses.

BACKGROUND OF THE INVENTION

Alarm management systems carried onboard aircraft are generally charged with the generation, the verification of fault or information messages, and the delivery of instructions to the pilot. Today, these systems are becoming increasingly complex and are linked with a large number of critical systems.

At the outset, the information was provided to the pilot in the form of telltale or flashing lights, optionally associated with texts that the pilot was able to read on a monitoring screen. One of the problems related to these telltale lights resides in their directional aspect: there is a risk of them not being seen. Audible alarms, such as sirens, or quasi-audible alarms, such as vibrating sticks, which made it certain that the pilot had acknowledged them, appeared later.

Currently, with the aim of improving pilot aids, alarm management systems comprising voice synthesis devices are being developed. Explicit announcements can thus be made, enabling the pilot to concentrate exclusively on pure piloting. For example, during a landing manoeuvre, the altitude of the aircraft can be regularly announced to the pilot, who is therefore no longer constrained to watch his altimeter.

In this context, it is sought to provide the pilot with more and more information in the form of announcements on the basis of voice syntheses. The difficulties to be resolved pertain on the one hand to the availability of the audible information and on the other hand to the risks of ambiguity related to overly complex or overly numerous announcements. These issues are critical since the audible announcements may be directly interpreted by the pilot and give rise to an action on his part. The integrity of the announcements made is therefore paramount.

Consequently, onboard alarm management systems conventionally comprise several independent devices for generating voice announcements. In parallel, they integrate a simple priority management device which selects the priority device for generating voice announcements.

Current systems are generally based on a binary item of information related to the presence or otherwise of energy at the output of a device for generating voice announcements and bound for a loudspeaker. The main drawback of this technique resides in the risk that fault modes of equipment belonging to the sound generating chain, typically amplifiers, generate noise. If this spurious noise is emitted at the output of the priority device for generating voice announcements, it will remain active. In the case where it failed to detect a nevertheless substantiated fault, the latter would not be announced even if another device for generating voice announcements has detected it. The consequences may therefore be critical.

Another undesirable effect also appears in this case: the noise generated by a fault mode, for example an amplifier fault mode, is emitted by the loudspeaker, broadcasting an unpleasant sound in the cockpit.

In order to alleviate the drawbacks explained above, the invention proposes a method and a device for detecting the digital origin of an analogue signal aimed at guaranteeing the integrity of the voice announcements made to the pilot by way of an alarm management system.

SUMMARY OF THE INVENTION

For this purpose, the subject of the invention is a method for detecting the digital origin of an analogue signal comprising the following steps:

- the analogue signal is partially diverted with the aid of a diverter,
- the partially diverted analogue signal is rectified by a rectifier so as to obtain a pulse comb,
- the pulse comb is thereafter conveyed to a resonator, tuned to a frequency which is a multiple of that of the digital samples,
- if and only if the analogue signal has been synthesized on the basis of the said digital samples, the resonator enters resonance and is sustained,
- finally, a detector detects the energy level accumulated by the resonator and compares it with a detection threshold making it possible to generate a validity signal.

Advantageously, in the method for detecting the digital origin of an analogue signal according to the invention, the analogue signal being emitted by a digital-analogue converter on the basis of digital samples, and exhibiting a discretization level related to the said digital-analogue converter, the resonator/detector assembly is designed in such a way that, once the detection threshold has been reached, making it possible to guarantee the digital origin of the analogue signal, the resonator can be sustained by a succession of digital samples differing between them of the lowest available discretization level at the output of the said digital-analogue converter.

The invention also resides in a device for detecting the digital origin of an analogue signal, intended for an onboard alarm management system, and making it possible to implement the previously described method according to the invention, an analogue signal being conveyed to the input of the said device, the said device comprising:

- a diverter,
- a rectifier,
- a resonator,
- a detector,
- making it possible to provide a validity signal determining the digital or non-digital origin of the said analogue signal.

Advantageously, the said validity signal is binary.

Advantageously, an alarm management system carried onboard an aircraft, comprising a device for generating announcements of faults or information intended for the pilot, in the form of analogue synthesis signals, can comprise a device for detecting the digital origin of an analogue signal according to the invention.

Advantageously, the device for generating announcements of faults or information intended for the pilot comprises a list of digital samples of which a series of digital samples is emitted towards a digital-analogue converter at the output of which the analogue signal is conveyed to the said device for detecting the digital origin of an analogue signal which diverts a fraction thereof, the remainder of the said analogue signal passing through a low-pass filter providing a final analogue signal which, if the validity signal guarantees the digital origin of the analogue signal, ends up at a loudspeaker device.

Advantageously, a security bit attesting to the integrity of the analogue signal synthesized on the basis of the emitted series of digital samples is generated and associated with the validity signal.

Advantageously, the list of digital samples can comprise inaudible sounds, the digital origin and validity of which are detected by the device for detecting the digital origin of an analogue signal.

Advantageously, the resonator is tuned to a frequency which is a multiple of that of the digital samples.

Advantageously, an alarm management system can comprise at least one second device for generating announcements of faults or information intended for the pilot.

Advantageously, the device for detecting the digital origin of an analogue signal makes it possible to select the priority device for generating announcements of faults or information intended for the pilot.

Advantageously, when a sole device for generating announcements of faults or information intended for the pilot detects a fault, the said alarm management system informs the pilot thereof, enabling him to conclude that there is a possible malfunction of the said sole device for generating announcements of faults or information intended for the pilot that detected a fault.

BRIEF DESCRIPTION OF THE DRAWINGS

Other characteristics and advantages of the invention will become apparent with the aid of the description which follows in conjunction with the appended drawings which represent.

DETAILED DESCRIPTION OF THE INVENTION

Figure 1:
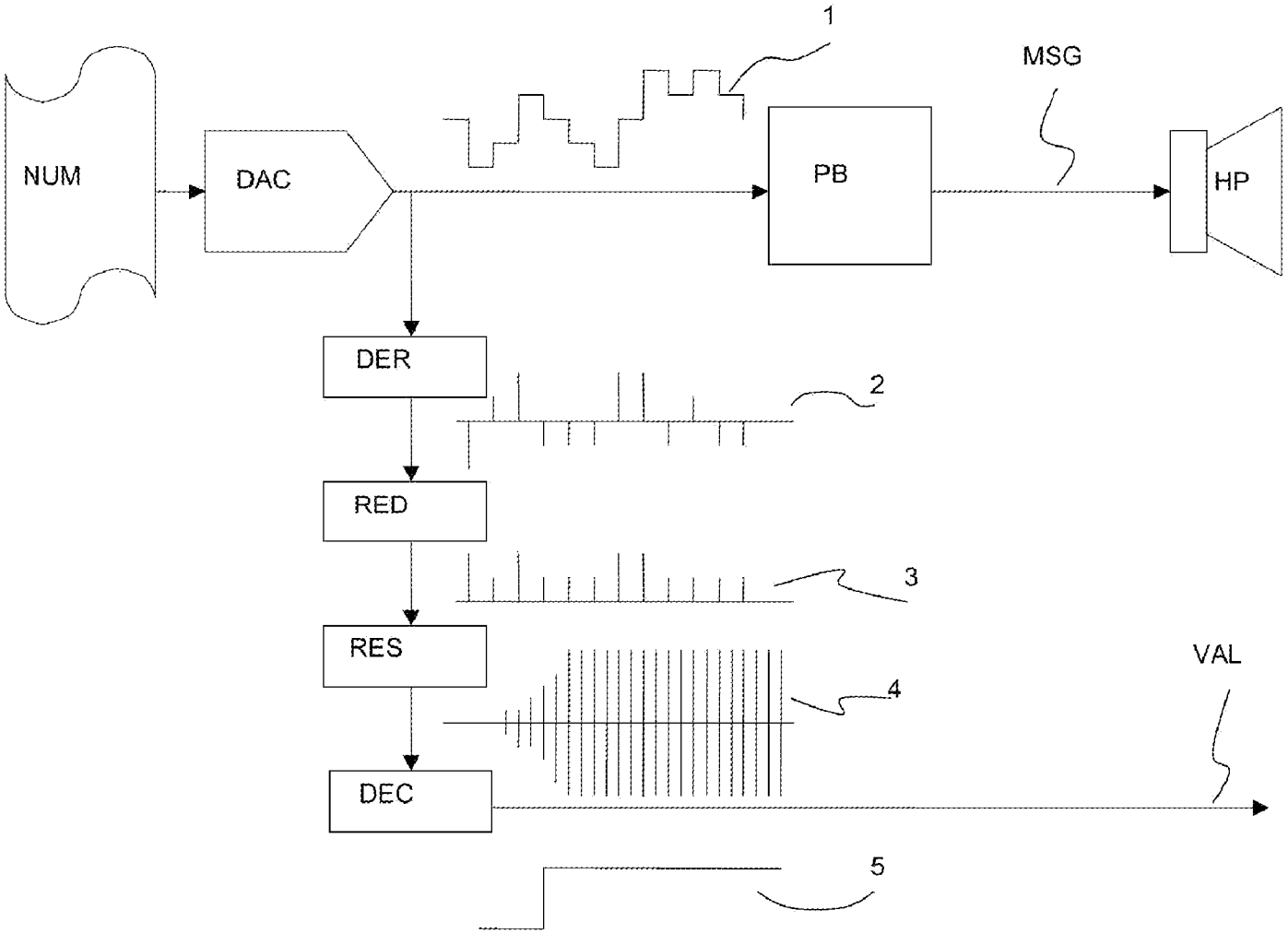
FIG. 1: the diagram of the principle of the invention.

FIG. 1 represents the principle of the device for detecting the digital origin of an analogue signal according to the invention. This device is situated within an alarm management system capable of generating "voice announcements" based on a set of digital samples NUM. In the case of faults or when information must be provided, to the pilot of an aircraft for example, a series of digital samples can be emitted. This series of digital samples is converted into an analogue signal by a digital-analogue converter DAC. It is at the output of the said digital-analogue converter DAC that the device for detecting the digital origin of an analogue signal is preferably placed. In all cases, it must be supplied with the analogue signal 1 before the latter is smoothed, as here by the low-pass filter PB. Indeed, at the output of the digital-analogue converter, the analogue signal 1 exhibits a "staircase" appearance, which will be detected so as to determine the digital origin of the signal. The diverter DER of the device diverts a fraction 2 of the analogue signal 1. This fraction 2 of the analogue signal 1 is thereafter rectified by the rectifier RED so as to obtain a pulse comb 3. This pulse comb 3 then excites a resonator RES tuned to a frequency which is a multiple of that of the digital samples. Therefore, if the analogue signal 1 does indeed arise from a combination of digital samples of the set NUM, the resonator RES enters resonance and is sustained, providing as output a signal 4 comprising resonance spikes. At the extremity of the chain the detector DEC compares the signal 4 arising from the resonator RES with a detection threshold 5. If the resonator RES is in resonance, the detection threshold 5 is reached. Consequently, the detector DEC provides a binary signal corresponding to the validity signal VAL. The validity signal VAL can thereafter be utilized by the system so as to decide to let the voice announcement MSG reach the loudspeaker HP.

The idea is therefore to detect the "staircase" appearance of the analogue signal 1. The device according to the invention makes it possible to guarantee the digital origin of the said analogue signal 1, before the latter is filtered and conveyed to the loudspeaker HP. In the case of an onboard alarm management system comprising several sub-assemblies for detecting and generating announcements of faults or information, this helps with the secure selection of the priority sub-assembly. Indeed, the fault modes of equipment such as the digital-analogue converter DAC or amplifiers possibly present in the voice announcement-generating chain, and which may generate noise, do not run the risk of being recognized as genuine messages and they cannot reach the loudspeaker HP nor give rise to the retaining of the priority status by the device which comprises them.

It should be noted that it is advantageously possible to combine the validity signal VAL emitted by the device according to the invention with a security bit guaranteeing the integrity of the series of digital samples ending with the generation of the analogue signal 1 and then with the voice announcement MSG. The definition and the utilization of such a security bit are described in French patent No. FR2723222A1. The association of the security bit and of the validity signal VAL makes it possible to reach a very high security level.

Figure 2:
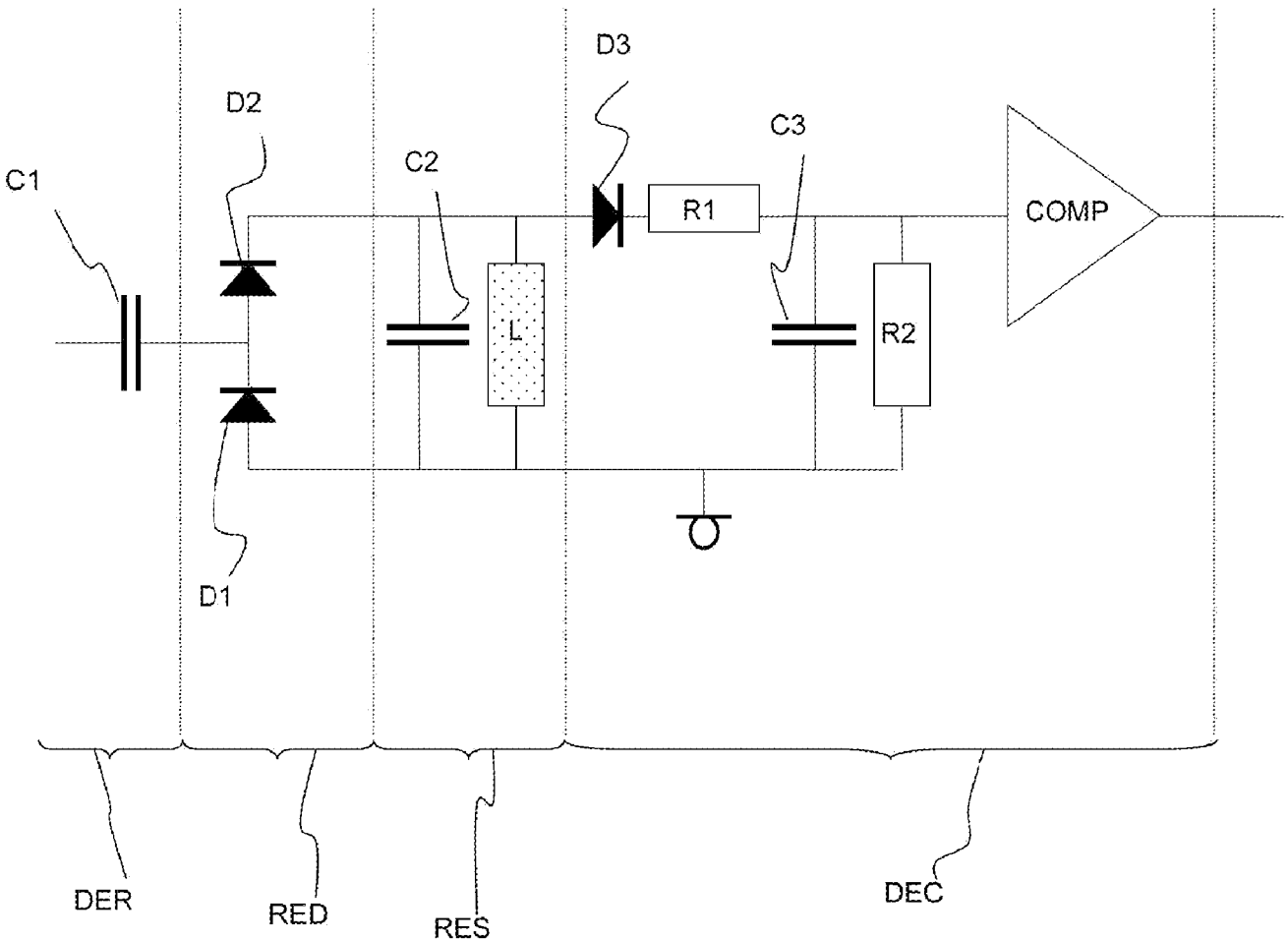
FIG. 2: the diagram of a simple exemplary embodiment of the invention.

FIG. 2 illustrates an exemplary embodiment of the device according to the invention, based on a very simple electronic circuit. The diverter DER consists of a simple capacitor C1 making it possible to divert a low-energy fraction 2 of the analogue signal 1. The rectifier RED is, basically, composed of two diodes D1 and D2 making it possible to convey a pulse comb to the resonator RES. The resonator RES comprises a capacitor C2 and an inductor L in parallel. The values of the capacitor C2 and of the inductor L are such that the resonant frequency of the said resonator RES, in this instance $$\left(\frac{1}{2\cdot\pi\cdot\sqrt{L\cdot C2}}\right),$$

is a multiple of the frequency of the constituent digital samples of the set of digital samples NUM. If the analogue signal 1 is based on the said digital samples, the resonator RES enters resonance. To finish, the detector DEC comprises a diode D3 followed by a resistor R1 of high impedance and a capacitor C2 in parallel with a second resistor R2. The comparator COMP is charged with comparing the signal arising from this circuit with a detection threshold. If this threshold is reached, the validity signal VAL is true. It is false in the converse case. The true or false state of the validity signal VAL conditions the access of the voice announcement MSG to the loudspeaker HP.

Furthermore, with the device according to the invention, moments of silence can without any problem be integrated into the voice announcements without any risk of being interpreted as invalid. Indeed, these silences must simply be coded as inaudible sounds, consisting of an alternation of samples of zero mean value, but enabling the resonator RES to be sustained. Likewise, the device according to the invention applies without any restriction to an analogue signal which might arise from a mixture of several voice synthesis sources.

To summarize, the device according to the invention exhibits the essential advantage of making it possible to guarantee the digital origin and the integrity of an analogue signal; it is intended for alarm management systems carried onboard aircraft and fitted with devices for generating voice announcements.

The invention claimed is:

1. A method for detecting the digital origin of an analog signal, comprising the steps of:

diverting a predetermined portion of the analog signal by use of a diverter, to produce a partially diverted analog signal;

rectifying the partially diverted analog signal by use of a rectifier, to produce a pulse comb;

conveying the pulse comb to a resonator, wherein the resonator is tuned to a frequency that is a multiple of a frequency of predetermined digital samples, wherein the resonator enters a sustained resonance if the analog signal has been synthesized on the basis of the predetermined digital samples;

detecting the energy level accumulated by the resonator; and comparing the detected energy level to a detection threshold to enable generation of a validity signal.

2. The method for detecting the digital origin of an analog signal according to claim 1, wherein:

the analog signal is produced by a digital-analog converter based on digital samples, and the analog signal exhibits a discretization level related to the digital-analog converter;

a resonator-detector assembly which validates the digital origin of the analog signal after the detection threshold has been reached, the method further comprises the step of:

sustaining the resonator by use of a succession of digital samples that differ by the lowest available discretization level at the output of said digital-analog converter.

3. A device for detecting the digital origin of an analog signal, for an onboard alarm management system, the analog signal provided to an input of said device, the device comprising:

a diverter having a diverter input and a diverter output, the diverter input in communication with the input of the device, the diverter configured to divert a predetermined portion of the analog signal from the diverter input to the diverter output;

a rectifier having a rectifier input and a rectifier output, the rectifier input in communication with the diverter output, the rectifier configured to generate at the rectifier output a pulse comb from the predetermined portion of the analog signal;

a resonator having a resonator input and a resonator output, the resonator input in communication with the rectifier output, the resonator configured to have a resonant frequency that is a multiple of the frequency of constituent digital samples that correspond to the analog signal, the resonator configured to generate resonance spikes at the resonator output when the resonator is in sustained resonance;

a detector having a detector input and a detector output, the detector input in communication with the resonator output, the detector configured to compare the resonator output to a detection threshold, the detector output providing a validity signal to indicate a digital or non-digital origin of the analog signal.

4. The device according to claim 3, wherein said validity signal comprises a binary signal.

5. An alarm management system carried onboard an aircraft, comprising:

an announcement device, to generate announcements of at least one of faults and information intended for the pilot, the announcements provided as analog synthesis signals;

a detection device, to detect the digital origin of an analog signal, the detection device comprising:

a diverter having a diverter input and a diverter output, the diverter input in communication with the input of the device, the diverter configured to divert a predetermined portion of the analog signal from the diverter input to the diverter output;

a rectifier having a rectifier input and a rectifier output, the rectifier input in communication with the diverter output, the rectifier configured to generate at the rectifier output a pulse comb from the predetermined portion of the analog signal;

a resonator having a resonator input and a resonator output, the resonator input in communication with the rectifier output, the resonator configured to have a resonant frequency that is a multiple of the frequency of constituent digital samples that correspond to the analog signal, the resonator configured to generate resonance spikes at the resonator output when the resonator is in sustained resonance;

a detector having a detector input and a detector output, the detector input in communication with the resonator output, the detector configured to compare the resonator output to a detection threshold, the detector output providing a validity signal to indicate a digital or non-digital origin of the analog signal.

6. The alarm management system according to claim 5, further comprising:

a digital-analog converter having an input and providing an analog signal at its output, the input of the digital-analog converter configured to receive digital samples from the announcement device, the analog signal at the output of the digital-analog converter being provided to the detection device, which diverts a fraction thereof, the remainder of the analog signal passing through a low-pass filter providing a final analog signal which, if the validity signal validates the digital origin of the analog signal, is provided to a loudspeaker device.

7. The alarm management system according to claim 6, wherein a security bit attesting to the integrity of the analog signal synthesized on the basis of the emitted series of digital samples is generated and associated with said validity signal.

8. The alarm management system according to claim 6, wherein said list of digital samples can comprise inaudible sounds, the digital origin and validity of which are detected by said device for detecting the digital origin of an analog signal.

9. The alarm management system according to claim 6, wherein said resonator is tuned to a frequency which is a multiple of that of said digital samples.

10. The alarm management system according to claim 5, wherein it comprises at least one second device for generating announcements of faults or information intended for a pilot.

11. The alarm management system according to claim 10, wherein said device for detecting the digital origin of an analog signal makes it possible to select the priority device for generating announcements of faults or information intended for the pilot.

12. The alarm management system according to claim 10, wherein, when a sole device for generating announcements of faults or information intended for the pilot detects a fault, said alarm management system informs the pilot thereof, enabling the pilot to determine that there is a possible malfunction of said sole device for generating announcements of faults or information intended for the pilot that detected a fault.

* * * * *